US005416382A

United States Patent [19]

L'Hermite

[11] Patent Number: 5,416,382

[45] Date of Patent: May 16, 1995

[54] PHOTOMULTIPLIER TUBE SEGMENTED INTO N INDEPENDENT PATHS ARRANGED AROUND A CENTRAL AXIS

[75] Inventor: Pierre L'Hermite, Brive, France

[73] Assignee: U.S. Philips Corporation, New York, N.Y.

[21] Appl. No.: 87,632

[22] Filed: Jul. 1, 1993

[30] Foreign Application Priority Data

Jul. 8, 1992 [FR] France ..... 92 08459

[51] Int. Cl.[6] ..... H01J 43/04

[52] U.S. Cl. ..... 313/532; 313/533; 313/536; 313/103 R; 313/105 R

[58] Field of Search ..... 313/532, 533, 536, 103 R, 313/105 R, 534, 542

[56] References Cited

U.S. PATENT DOCUMENTS

| | | | |
|---|---|---|---|
| 4,816,718 | 3/1989 | Lavoute et al. | 313/534 |
| 4,980,604 | 12/1990 | L'Hermite | 313/533 |
| 5,061,875 | 10/1991 | Tomasetti et al. | 313/533 |
| 5,077,504 | 12/1991 | Helvy | 313/532 X |
| 5,126,629 | 6/1992 | Chopy | 313/533 |

*Primary Examiner*—Sandra L. O'Shea
*Assistant Examiner*—Ashok Patel
*Attorney, Agent, or Firm*—Norman N. Spain

[57] ABSTRACT

A photomultiplier tube in which a photoelectron beam (42) is divided in N independent paths by means of an electron-optical device. The optical device includes a first cup-shaped focusing electrode (25) having a flat bottom portion of polygonal or circular shape, in which N apertures (30*a*), (30*b*) are formed, and having raised side faces (28*a*), (28*b*) which extend towards the photocathode (12), viewed in the radial directions corresponding to the elementary photomultipliers, and side faces having V-shaped recesses between these directions. The optical device is completed by a deflection electrode (35) which is brought to approximately the same potential as the photocathode and which is centrally arranged close to the bottom portion of the focusing electrode (25). The assembly is followed by a multiplier (16) of the perforated sheet-type whose focusing electrode (161) has projecting portions (41*a*), (41*b*), the multiplier being followed by N anode plates (20*a*), (20*b*).

5 Claims, 3 Drawing Sheets

PHOTOMULTIPLIER TUBE SEGMENTED INTO N INDEPENDENT PATHS ARRANGED AROUND A CENTRAL AXIS

BACKGROUND OF THE INVENTION

The invention relates to a photomultiplier tube comprising a sealed envelope having a longitudinal axis of symmetry, which tube is radially segmented into N segments which are disposed at regular intervals around said longitudinal axis, each segment having an elementary photomultiplier, said tube comprising, more specifically, a photocathode arranged on the inner surface of the faceplate of the envelope, which is transparent to light, an electron multiplier of the leaf type which is arranged so as to have N multiplication paths which correspond to N elementary photomultipliers, and further comprising an electron-optical device which ensures that the photoelectrons are divided in N multiplication paths, depending on the position of the photoelectrons when they leave the photocathode.

A photomultiplier of this type is known from EP-A-428215(which corresponds to U.S. Pat. No. 5,126,629). According to said document, the aim is to provide, more specifically, a category of photomultipliers having a small number of N paths and which can be produced in a simple manner and at low cost.

A typical application of this type of photomultiplier consists in assembling a plurality of tubes into a mosaic in order to determine the positions in space of localized luminous phenomena, originating, for example, from scintillators placed in front of each tube. By using segmented photomultiplier tubes whose construction is not very complicated and, hence, relatively cheap, substantial economies can be realised in the manufacture of such an analysis mosaic. To ensure a satisfactory measuring accuracy, the different elementary photomultipliers used to assemble each segmented tube must exhibit minimal differences in performance between the tubes and the segments while also avoid crosstalk between the paths of one single tube.

The requirement of constructional simplicity is met, to a certain degree, by the segmented tube known from the above-mentioned document, i.e. the electron beam issuing from the photocathode is divided in N different paths, depending on the position of the electrons when they leave the photocathode; said division not being realised by physical means, such as partitions, but rather by an adequate distribution of the electric field. The majority of the electrodes used in said tube have different paths in common, which leads to a very simple construction.

SUMMARY OF THE INVENTION

It is an object of the invention to improve the known photomultiplier tube, in particular, as regards the efficiency with which the photoelectrons are collected and to the further reduction of crosstalk between two paths. Said improvement concerns, in particular, the electron-optical device which serves to divide the photoelectron beam in different paths, as well as the manner in which the electron multiplication on the focusing electrode is realised, even though the electrons are further multiplied in a manner similar to that described in the known photomultiplier tube.

A photomultiplier tube segmented in accordance with the invention is characterized in that said optical device consists of a cup-shaped focusing electrode having a flat bottom and side faces extending towards the photocathode, and the axis of symmetry of said focusing electrode substantially coinciding with the longitudinal axis of the envelope, said bottom being located in the proximity of the electron multiplier and comprises, in each of the N segments, an aperture through which pass the electrons after their first multiplication at the bottom of this dynode in areas, termed active areas, situated between said apertures and the side faces of the focusing electrode, which side faces comprise raised portions extending towards the photocathode and recessed, V-shaped portions, the highest portions being situated opposite each segment, and the inventive photomultiplier tube is further characterized in that said optical device is completed by a deflection electrode which is brought to substantially the same potential as the photocathode, said deflection electrode being centrally arranged, near the bottom of the focusing electrode.

Thus, the electrons issuing from the photocathode are electronically divided in N segments of the tube by means of an electric field which is adequately distributed without using physical partitioning means which would increase the complexity of the construction. Unlike the known photomultiplier tube, in the photomultiplier tube in accordance with the invention, the electrons issuing from the photocathode are directed on to solid surfaces of the focusing electrode, termed "active zone", resulting in a substantially improved collection efficiency. The electrons multiplied by the focusing electrode (which thus function as a dynode) pass through the apertures formed in said focusing electrode and are then collected by the subsequent input electrode of the electron multiplier.

Advantageously, the photomultiplier tube in accordance with the invention is characterized in that the sheet-type multiplier comprises a first electrode having N projecting portions arranged in such a manner that they penetrate into the apertures in the first dynode on the side of the active areas.

Such an arrangement facilitates the focusing of the secondary electron beams to the input of the electron multiplier.

The photomultiplier tube in accordance with the invention, which can be constructed very economically due to the fact that the independent segments are regularly arranged around the longitudinal axis of the envelope, aims in particular at a number of N segments which is relatively small, for example in the range from 2 to 8. If a mosaic of identical tubes is used, it is important to minimize the number of blind zones, i.e. the number of interstices between the individual tubes. For this reason, the envelope of the tube in accordance with the invention advantageously has a polygonal section, the number of sides being a multiple of N, and hence the focusing electrode has a bottom whose shape is substantially similar to that of said polygon.

In a first embodiment, N is equal to 2, the focusing electrode has a rectangular bottom portion provided with two oblong, parallel apertures which are symmetrically arranged, said dynode having four flat, raised side faces, two oppositely located faces being rectangular and arranged in the longitudinal direction of the apertures, whereas the two other side faces have V-shaped recesses, the deflection electrode being in the form of a prism having a triangular section, the ribs of which extend parallel to the longitudinal direction of the apertures. In this case, the envelope of the tube and the first dynode may have a square section or a rectangular section, the proportion of the sides being 2:1, so that two elementary photomultipliers of square section can be provided.

Another embodiment of the invention is characterized in that N is equal to 4, the focusing electrode has a rectangular bottom portion in which four apertures are formed which are symmetrically arranged on the diagonals of the bottom portion, the four raised side faces of the focusing electrode being flat and having V-shaped recesses, and in that the deflection electrode is in the form of a pyramid having a polygonal base with a symmetry of order 4, or the deflection electrode is conically shaped. Of course, the above-mentioned rectangular shape is to be understood to include a square shape, which is particularly suitable in the present case.

In accordance with said two embodiments of the invention, the construction of the photomultiplier tube remains very simple and very economical.

For a larger number of N, use can be made of an envelope having a circular section and a first cup-shaped focusing electrode having a circular bottom portion; in this manner the construction of the tube is simplified to a certain extent, while the reduction of blind zones of a mosaic of tubes is no longer a major problem.

The following description which will be given with reference to the accompanying drawings, by way of non-limitative example, will make the nature of the invention better understood and how it can be realized.

DETAILED DESCRIPTION OF THE PREFERRED EMBODIMENT

Figure 1:
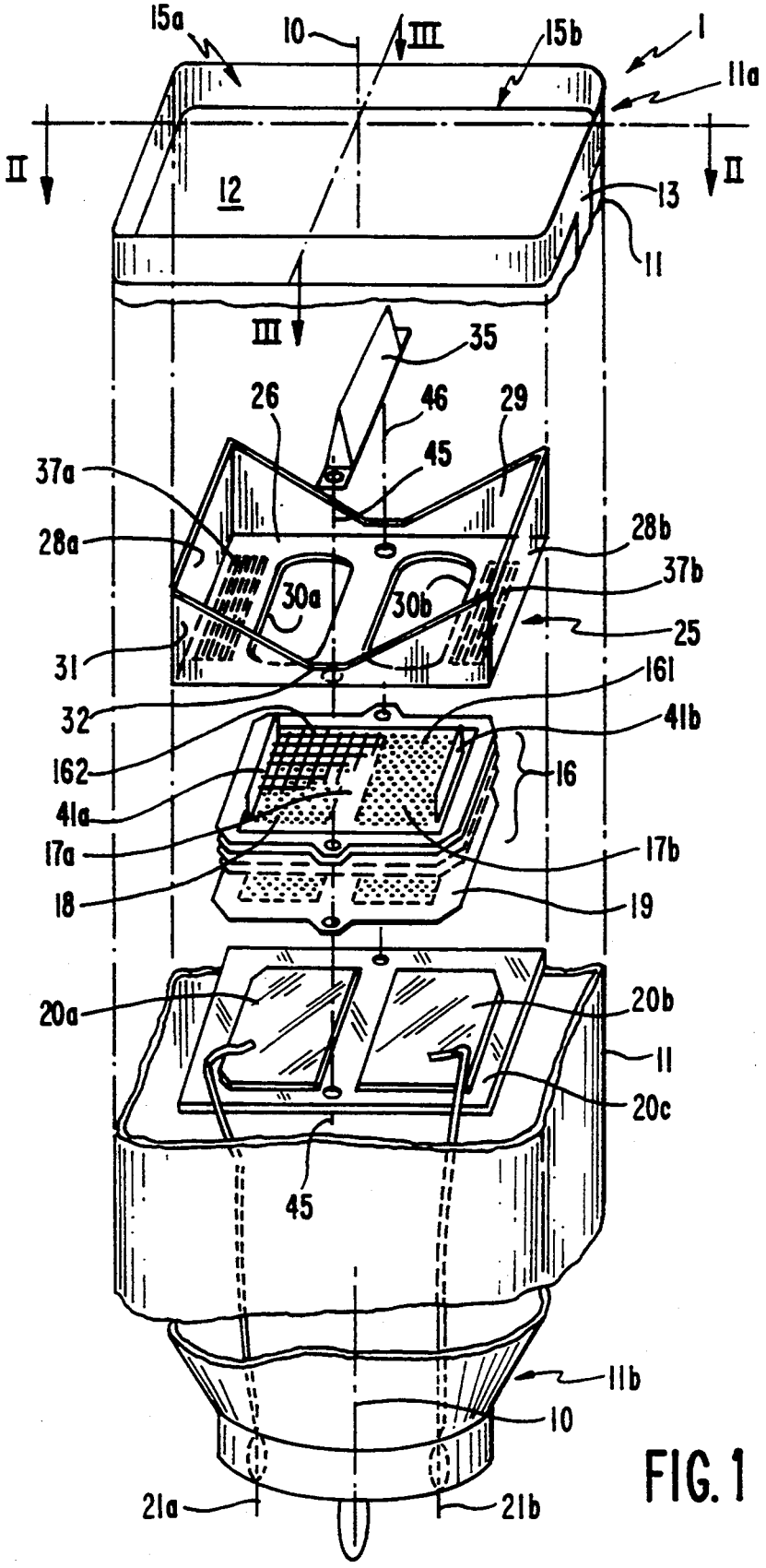
FIG. 1 is a diagrammatic, exploded view of a first example of a photomultiplier tube in accordance with the invention, which is segmented into two independent paths.
Figure 2:
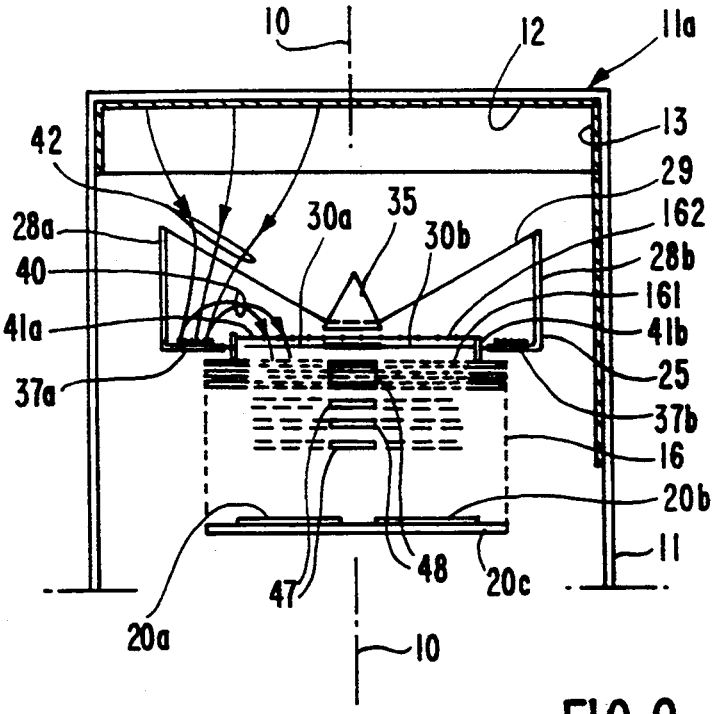
FIG. 2 is a sectional view taken on the line II—II of FIG. 1.
Figure 3:
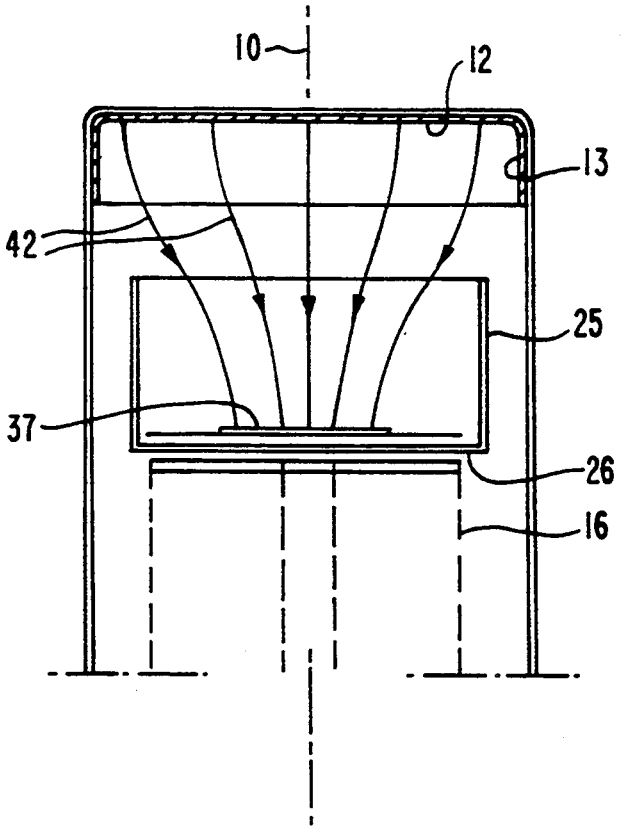
FIG. 3 is a sectional view of the tube of FIG. 1 taken on the line III—III, diagrammatically showing the trajectory of the photoelectrons.

A first example of a segmented photomultiplier tube is described with reference to FIGS. 1, 2 and 3. In this example, the number of segments is equal to 2, said segments are symmetrically arranged with respect to a line III—III which extends through the longitudinal axis 10 of the tube. Said line II—II is also used to diagrammatically show in section, in FIG. 3, the trajectory of photoelectrons leaving the photocathode, whereas the longitudinal line II—II, which extends perpendicularly to said line III—III and also passes through the longitudinal axis 10, is the line used for the sectional view of the tube shown in FIG. 2. For clarity, the FIGS. 1, 2 and 3 only show the principal constituent elements, with the exception of, notably, mechanical fixation means, insulating means and the output terminals. The photomultiplier tube 1 comprises a sealed, generally glass, envelope 11 whose face plate 11*a* is transparent to the light to be measured, and a rear portion 11*b* which has output terminals and the size of which can be reduced at the location of the terminals to a section of cylindrical shape. On the inner surface of the face plate 11*a* of the envelope, there is provided a photocathode 12 which circumferentially contacts a conducting metallization 13, enabling the potential of the photocathode to be fixed. Independent elementary photomultipliers 15*a*, 15*b*, also termed segments, are provided on either side of the line of symmetry III—III although, as will be shown hereinafter, the majority of the electrodes of the photomultiplier tube physically have the two segments in common.

The photomultiplier tube 1 comprises an electron multiplier 16 of the perforated sheet-type which is known from, in particular, EP-A-350111 (which corresponds to U.S. Pat. No. 4,980,604. It is noted that each dynode of the electron multiplier consists of a pair of perforated, staggered electrodes which are brought to the same potential or substantially the same potential. For a dynode of order i, the input electrode or "extracting half-dynode" has perforations which coincide with the output electrode, termed "multiplying half-dynode", of the preceding dynode (of order i-1), which is biased at a lower potential.

In a segmented photomultiplier tube, an arrangement known per se from EP-A-428215, which corresponds to U.S. Pat. No. 5,126,629 ensures that perforated zones 17*a*, 17*b* of the dynodes, where the electrons are multiplied, are separated by zones 18, called "neutral" zones, which correspond to the solid parts of these dynodes, thereby practically excluding that electrons shift from one path to another path.

The input first electrode of the electron multiplier 16 has a multiplying half dynode of the perforated sheet-type which is similar to the dynodes which follow, but said half dynode is preceded, at a short distance, by a grid-shaped electrode 162 which acts as an extracting half-dynode, yet with a higher "transparency". This electrode may be in the form of a surface of stretched threads. The electrode is brought to the same potential as the associated multiplying half-dynode, or to a substantially equal potential, i.e. a few volts.

The final electrode 19 of the multiplier 16 is followed by a pair of anode plates 20*a*, 20*b* which are insulated from each other and supported by an insulating plate 20*c*. By way of example, the output terminals of the anodes 20*a* and 20*b* are represented by sealed feed-throughs 21*a* and 21*b*. The electrons issuing from the photocathode 12 will be focused to one of the input zones 17*a* or 17*b* of the electron multiplier 16, depending on which side of the line of symmetry III—III they originate from.

The photoelectrons are mainly divided by a focusing electrode 25 which is generally in the form of a quadrangular cup having a fiat bottom 26 and raised side faces 28 extending towards the photocathode 12. The planes of symmetry of the first dynode 25 intersect according to an axis which coincides substantially with the longitudinal axis 10 of the tube. The bottom 26 of the dynode 25 is positioned close to the electron multiplier 16 and has two oblong apertures 30*a*, 30*b* arranged so that they correspond to the input zones 17*a* and 17*b* of the electron multiplier. The four side faces 28*a*, 28*b*, 29 and 31 of the focusing electrode 25 are fiat and pairwise identical. The facing side faces 28*a* and 28*b* have a rectangular shape and they are highest in the direction of the photocathode 12, whereas the two facing side faces 29 and 31 have substantially V-shaped recesses, said side faces being lowest in the centre 32. Thus, the highest pans of the side faces of the focusing electrode 25 are those which extend in a direction corresponding to the radial direction according to the line II—II, the elementary photomultipliers 15*a* and 15*b* being arranged according to said direction.

A distribution of the electric field so as to facilitate the segmentation of the photoelectron beam in two portions on either side of the line III—III is completed by a deflection electrode 35 which, in this case, is in the form of a prism having a triangular section, the ribs of said triangle being parallel to the line III—III. This deflection electrode 35 is brought to a potential which is equal or substantially equal to that of the photocathode, and said electrode is centrally arranged near the bottom 26 of the focusing electrode 25. The focusing electrode 25 and the deflection electrode 35 together form an electron-optical assembly, a considerable part of the photoelectrons issuing from either one of the two halves of the photocathode 12 being focused in the direction of the bottom 26 of the focusing electrode 25, to two active areas 37*a* and 37*b*, indicated by hatchings in FIG. 1 and a bold line in FIG. 2. The active areas 37*a* and 37*b* are situated between the apertures 30*a*, 30*b* and the side faces 28*a*, 28*b*, respectively, of the first dynode 25, i.e. the side faces which are closest to the photocathode 12. After their first multiplication on the focusing electrode 25, the secondary electrons are channelled towards the first electrode of the electron multiplier 16 due to an expansion of the electric field caused by said focusing electrode, via the apertures 30*a* and 30*b*.

It is known from experience that the beam of secondary electrons 40 is shaped so that a better focusing to the input zone 17*a* and 17*b* of the first electrode of the electron multiplier 16 is obtained when said electrode is provided with two projecting portions 41*a* and 41*b* which extend towards the photocathode 12 and penetrate into the apertures 30*a* and 30*b* of the focusing electrode 25 along the active zones 37*a* and 37*b*.

In order to mechanically fix the different elements with respect to each other, establish electric connections between the elements and provide the output terminals of the envelope 11, use is made of known means, in particular as regards mechanical fixing, guide pins are used (not shown) which are situated in accordance with two axes 45 and 46 parallel to the axis 10 of the tube. These guide pins are provided with insulating tings such as the rings 47 and, if necessary, conducting spacers such as the spacers 48 (see FIG. 2).

A suitable electric field inside the photomultiplier tube 1 is obtained by using an (increasing) voltage range of the order of 80 to 150 volts between the dynodes of the electron multiplier 16, and a potential difference of the order of 200 to 400 volts between the photocathode and the first electrode of the multiplier 16. The focusing electrode 25 is biased at a voltage which corresponds substantially to the value in the middle of the range between the voltage of the photocathode and the voltage of the first electrode of the electron multiplier 16, i.e. approximately 100 to 200 volts when the photocathode is used as a reference with a value of 0 volt. The particular shape of the focusing electrode 25 causes the electron beam 42 issuing from the photocathode to be markedly focused to the active regions 37*a* and 37*b*, as shown in the sectional view of FIG. 2, and to be much less markedly focused in a direction at tight angles thereto, as shown in FIG. 3, which diagrammatically shows a plane projection of the trajectories of the beam 42. In FIG. 2, the repelling action of the deflection electrode 35 has an important effect on the focusing of the photoelectron beam 42, while the secondary electron beam 40, after the first multiplication on the focusing electrode 25, is passed on by the field created between the first electrode of the electron multiplier 16 and the focusing electrode 25 as well as by the expansion of the field via the apertures 30*a* and 30*b*.

The segmented photomultiplier tube which has just been described has a better collection efficiency than the tube described in EP-428215. This can be attributed to the fact that the first multiplication of the photoelectrons is effected on a continuous surface, thereby obtaining a higher multiplication efficiency than in the known tube in which the beam is directed on to a focusing electrode of the perforated sheet-type. Said focusing electrode has a degree of transparency which is detrimental to the collection efficiency which should be close to 100%. It is also known that, as regards the efficiency with which photoelectrons are collected, particularly when there are very few photoelectrons, the importance of the dynodes following the focusing electrode is very small and decreases for every subsequent dynode.

Figure 4:
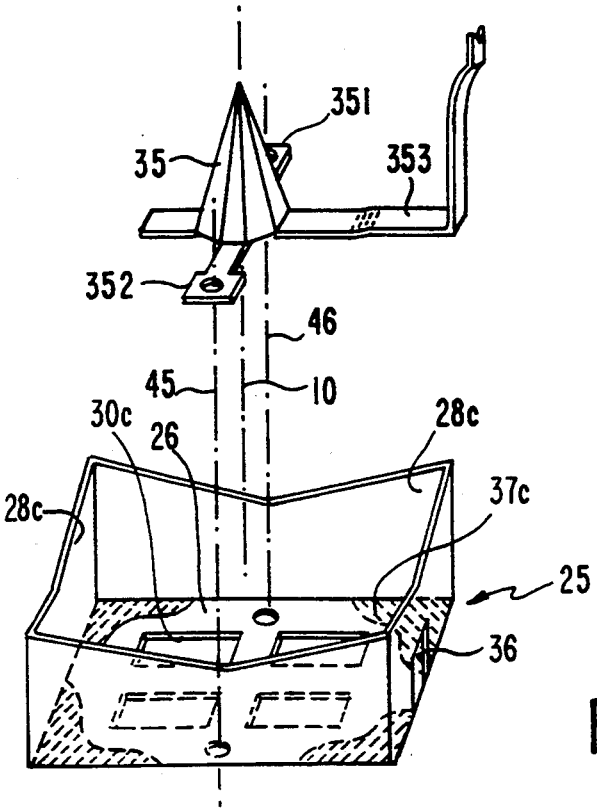
FIG. 4 is an exploded view of two elements of another exemplary embodiment of a segmented photomultiplier tube having 4 independent paths.
Figure 5:
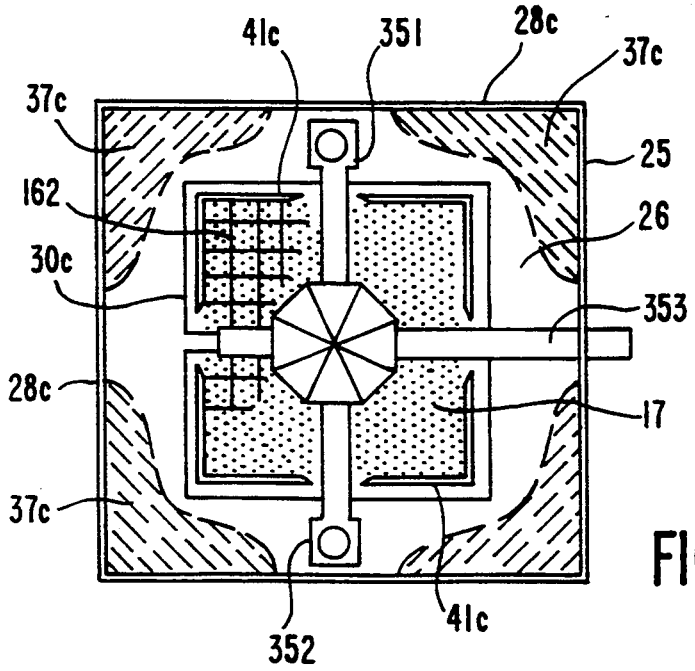
FIG. 5 is a top view of said elements.

FIGS. 4 and 5 relate to a second exemplary embodiment of a segmented photomultiplier tube in accordance with the invention. Wherever possible, elements referred to in these Figures and corresponding to those shown in FIGS. 1 to 3 bear the same reference numerals, In this second example, which relates to a photomultiplier tube segmented into four portions, FIG. 4 is an exploded view of the focusing electrode and the deflection electrode, and FIG. 5 is a top view of said elements. It is noted that FIG. 5 also shows parts of the electron multiplier which are situated below the above-mentioned elements.

In this example, the envelope of the tube (not shown) preferably has a square section. The focusing electrode 25 is cup-shaped having a square base with a flat bottom portion 26 and is provided with four apertures 30*c* which are symmetrically arranged around the central axis 10 and four flat side faces 28*c* which extend upwards in the direction of the photocathode. Moreover, each side face 28*c* has a recessed, V-shaped centre portion, so that the most prominent portions, extending towards the photocathode, are situated in the corners formed by two contiguous side faces 28*c*. The deflection electrode 35 has the shape of a pyramid with an octagonal base whose axis of symmetry coincides substantially with the longitudinal axis 10 of the tube. In a different version (not shown), said electrode 35 may alternatively be conically shaped with a circular base or it may have the shape of a pyramid with a square base. From a mechanical point of view, said deflection electrode 35 is provided with a support in the form of a crosspiece, two opposite branches 351 and 352 of which are used to fix said electrode, while the remaining branch 353 is used to connect the electrode to the potential of the photocathode by means of an extension of said branch which passes through an aperture 36 in the side face 28*c* of the focusing electrode 25. The combined effects of the V-shaped recesses of the side faces 28*c* of the focusing electrode 25 and the presence of the deflection electrode 35, create an electric field such that the photoelectrons issuing from the photocathode can be suitably distributed in four directions, corresponding to the diagonals at the bottom of the focusing electrode 25, depending on the place of departure of the photoelectrons in one of the four portions of this photocathode. These photoelectrons are focused to active areas 37*c*

(indicated by hatchings in FIGS. 4 and 5) which are situated in the comers at the bottom 26 of the focusing electrode 25. After a first multiplication on the focusing electrode 25, the secondary electrons are focused to each of the input zones 17 of the sheet-type multiplier (not shown in FIG. 4), while passing through the apertures 30*c* formed in the bottom of the focusing electrode 25.

The sheet-type electron multiplier which is similar to the one described in the first example comprises, in this case, four perforated sections instead of two and the first electrode of the sheet-type multiplier comprises, as described in the previous example, a grid-shaped electrode 162 as well as four projecting portions 41*c* which penetrate into the apertures 30*c* and bound these apertures on the two sides which extend in the direction of the active zones 37*c* (see FIG. 5). Of course, at the end of the sheet-type multiplier there is situated an assembly of four anode plates which correspond to the outlets of the four segments of the photomultiplier tube. This arrangement (not shown) is clear to those skilled in the art.

As shown in the above examples, which are not limited to 2 or 4 segments, the construction of a segmented tube in accordance with the invention remains rather simple and economical as said tube consists of a plurality of parallel, elementary tubes forming an integral body.

In a further simple embodiment (not shown in the drawings) the photocathode itself may be segmented into N active zones which are separated by inactive bands whose width is adapted, to obtain a similar effect, to that of the blind zones formed at the interstices between a plurality of tubes which are interconnected in the form of a mosaic. In this manner an additional reduction of crosstalk between the paths of one single tube is obtained without a significant loss of resolution of such a tube assembly. The inactive bands marking the boundaries of the active segments of the photocathode can be obtained in a very simple manner, for example, by locally depositing a metal layer which is opaque to light.

The invention is suitable for any kind of segmentation into N independent paths, generally not exceeding 10, which paths are radially disposed and regularly spaced at an angle about a central axis of the tube. The envelope of the tube may be in the form of a polygon, the number of side faces corresponding to the number of paths provided, or may have a cylindrical shape when the neutral zones do not form a major drawback in the assembly of identical tubes. In each of the segments of the tube, the focusing electrode in the form of a polygonal or cylindrical cup, comprises raised side faces which are closer to the photocathode in the main direction of these segments of the tube and side faces having substantially V-shaped recesses in the regions situated between said segments. Said focusing electrode is always associated with a deflection electrode which is brought to substantially the same potential as the photocathode, said deflection electrode being centrally arranged close to the bottom of the focusing electrode and, depending on the embodiment, has the shape of a pyramid or a cone.

I claim:

1. A photomultiplier tube comprising a sealed envelope having a longitudinal axis of symmetry, said tube being radially segmented into N segments which are disposed at regular intervals around said longitudinal axis, N being greater than 1, each segment having an elementary photomultiplier, comprising: a photocathode disposed on the inner surface of the envelope, said photocathode issuing electrons; an electron multiplier of the sheet type having N multiplication paths, said electron multiplier having a first electrode; and a focusing arrangement for directing electrons issuing from the photocathode into N multiplication paths; the focusing arrangement including a cup-shaped focusing electrode having a bottom face with N apertures and side faces extending towards the photocathode substantially arranged between the photocathode and the first electrode of the electron multiplier and a deflection electrode disposed inside the cup-shaped focusing electrode and centrally positioned with respect to the cup-shaped focusing electrode, the cup-shaped focusing electrode being brought to a potential higher than the potential of the photocathode and the deflection electrode being brought to a potential substantially the same as the photocathode so that a focusing electrical field formed by the focusing electrode and the deflection electrode directs photo-electrons issued from the photocathode on solid regions of the bottom of the focusing electrode to generate secondary electrons, said regions being situated between the apertures in the bottom and the side faces of the focusing electrode, and the first electrode of the electron multiplier being proximate to the apertures of the focusing electrode, said first electrode being brought on a potential higher than the potential of the focusing electrode, such that an electric field is created between the first electrode of the electron multiplier and the focusing electrode by which electric field the secondary electrons are passed through the apertures of the focusing electrode to the first electrode of the electron multiplier.

2. A photomultiplier tube as claimed in claim 1, characterized in that the sheet-type electron multiplier includes input electrode having N projecting portions arranged in such a manner that they penetrate into the apertures in the focusing electrode.

3. A photomultiplier tube as claimed in claim 1, characterized in that the envelope has a polygonal section, the number of sides being a multiple of N, and the focusing electrode has a bottom whose shape is substantially similar to that of said polygon.

4. A photomultiplier tube as claimed in claim 3, characterized in that N is equal to 2, the focusing electrode having a rectangular bottom portion provided with two oblong, parallel apertures which are symmetrically arranged, and four flat, raised side faces, two oppositely located faces being rectangular and arranged in the longitudinal direction of the apertures, whereas the two other side faces have V-shaped recesses, the deflection electrode being in the form of a prism having a triangular section, the ribs of which extend parallel to the longitudinal direction of the apertures.

5. A photomultiplier tube as claimed in claim 3, characterized in that N is equal to 4, the focusing electrodes having a rectangular bottom portion in which four apertures are formed which are symmetrically arranged on the diagonals of the bottom portion, the four raised side faces of the focusing electrode being flat and having V-shaped recesses, and in that the deflection electrode is in the form of at least one of, a pyramid having a polygonal base with a symmetry of order 4, and a cone.

* * * * *